US012638012B2

(12) United States Patent
Glavana et al.

(10) Patent No.: US 12,638,012 B2
(45) Date of Patent: May 26, 2026

(54) APPARATUS FOR CONTROLLING PRESSURE OR FLOW IN A FLUIDIC SYSTEM

(71) Applicant: FLUIGENT, Le Kremlin-Bicetre (FR)

(72) Inventors: Cristian Glavana, Viroflay (FR); Jean-Louis Viovy, Paris (FR)

(73) Assignee: FLUIGENT, Le Kremlin-Bicetre (FR)

( * ) Notice: Subject to any disclaimer, the term of this patent is extended or adjusted under 35 U.S.C. 154(b) by 68 days.

(21) Appl. No.: 18/269,110

(22) PCT Filed: Dec. 20, 2021

(86) PCT No.: PCT/EP2021/086796
§ 371 (c)(1),
(2) Date: Jun. 22, 2023

(87) PCT Pub. No.: WO2022/136275
PCT Pub. Date: Jun. 30, 2022

(65) Prior Publication Data

US 2024/0133370 A1 Apr. 25, 2024

(30) Foreign Application Priority Data

Dec. 22, 2020 (EP) ..... 20306659

(51) Int. Cl.
*F04B 43/04* (2006.01)
*F04B 11/00* (2006.01)
*F04B 45/047* (2006.01)

(52) U.S. Cl.
CPC ..... *F04B 43/046* (2013.01); *F04B 11/0091* (2013.01); *F04B 45/047* (2013.01)

(58) Field of Classification Search
CPC .. F04B 11/0091; F04B 43/043; F04B 43/046; F04B 45/047; F04B 43/095; F04B 19/006; F04B 49/225; F04B 49/24
See application file for complete search history.

(56) References Cited

U.S. PATENT DOCUMENTS 6,637,463 B1 10/2003 Lei et al.
7,607,641 B1 10/2009 Yuan
(Continued)

FOREIGN PATENT DOCUMENTS

GB 2569417 A * 6/2019 ..... F04B 43/046
WO 2018184971 A1 10/2018

OTHER PUBLICATIONS

EP20306659, European Search Report, dated May 25, 2021, 2 pages.
(Continued)

*Primary Examiner* — Wesley G Harris
*Assistant Examiner* — Charles W Nichols
(74) *Attorney, Agent, or Firm* — Flaster Greenberg P.C.

(57) ABSTRACT

The present invention relates to an apparatus (2) for controlling pressure or flow in a fluidic system (3), the apparatus (2) comprising: a first connection device (301) comprising a pumping device (304) and a main outlet (310); a second connection device (302) comprising a flow restriction (305); a third connection device (303) comprising a valve with a modifiable aperture (306); wherein the second connection device (302) and the third connection device (303) are connected to the first connection device (301) at a position between the pumping device (304) and the main outlet (310).

17 Claims, 9 Drawing Sheets

(56) References Cited

U.S. PATENT DOCUMENTS

| | | | | |
|---|---|---|---|---|
| 7,972,561 | B2 * | 7/2011 | Viovy | B01L 3/502738 137/262 |
| 2004/0163957 | A1 * | 8/2004 | Neyer | B01D 61/56 204/450 |
| 2006/0076068 | A1 * | 4/2006 | Young | B81C 1/00158 137/829 |
| 2014/0123728 | A1 * | 5/2014 | Mostowfi | G01N 30/12 210/103 |
| 2020/0188916 | A1 | 6/2020 | Fluigent | |

OTHER PUBLICATIONS

European App: 20306659.2, Communication, Jun. 2, 2021, 1 page.
European App: 20306659.2, Examination of Filed Application Documents, 2021.
PCT/EP2021/086796, International Search Report, 1 page.
PCT/EP2021/086796, International Search Report, dated Mar. 9, 2022, 2 pages.
PCT/EP2021/086796, International Search Report, dated Mar. 17, 2022, 1 page.
PCT/EP2021/086796, Written Opinion, 1 page.
PCT/EP2021/086796, Written Opinion, 2 pages.
PCT/EP2021/086796, Written Opinion, 4 pages.
PCT/EP2021/086796, Possible Steps After Receipt of ISR and WO/ISA, 2 pages.
EP20306659, Information on Search Strategy, 1 page.
PCT/EP2021/086796, Information on Search Strategy, 1 page.

* cited by examiner

APPARATUS FOR CONTROLLING PRESSURE OR FLOW IN A FLUIDIC SYSTEM

CROSS-REFERENCE TO RELATED APPLICATIONS

This application is the 371 National Stage of International Application No. PCT/EP2021/086796, filed Dec. 20, 2021, which claims priority to European Application No. 20306659.2, filed Dec. 22, 2020, the disclosures of which are incorporated herein by reference in their entireties.

TECHNICAL FIELD

The present invention relates to an apparatus for controlling pressure or flow in a fluidic system. The invention also relates to a method of controlling pressure in a fluidic system, and a method of controlling flow rate of a fluid in a fluidic system.

TECHNICAL BACKGROUND

Regulated pressure sources are a strong and increasing need in various areas of technology. In particular, they may be used to control pressure in a reservoir or in a channel, or to control flow rate in a fluidic system. Several types of systems, such as microfluidic based systems or biomedical systems, require pressure sources that are highly efficient and avoid the pulses typically generated by syringe pumps or peristaltic pumps.

Standard regulated pressure sources typically comprise an external pressure source and are thus rather bulky. Such external pressure sources may be a pressurized air line in a building or a pressurized air bottle; however, they require specialized fixed equipment, and they are not portable. Pumps having a sufficient power to drive standard pressure sources require high power consumption typically over 10 W, are rather noisy, and can induce vibrations. In addition, they must be operated continuously, which increases nuisances and power consumption. These pressure sources also have a high gas consumption, due of the continuous flow of fluid from the inlet to the outlet. The high gas consumption requires the external pressure source to deliver a relatively high flow of gas, and thus requires high pumping power.

Control of standard regulated pressure sources is another challenge. Some pressure sources exploit proportional valves which are difficult to control accurately in the vicinity of full closure. In order to guarantee a stable performance, the proportional valves should be operated far from the regime of operation near full closure, which results in a relatively high gas consumption. Providing a reasonable response time to control signals is another issue. In general, allowing a gas leakage reduces the response time, but at the expense of reduction of the maximum pressure and gas flow rate achievable.

Document U.S. Pat. No. 7,972,561 relates to a pressure monitoring system comprising a chamber configured to be connected at one end of at least one microchannel, an inlet circuit in fluid communication with the chamber, and an outlet circuit separate from said inlet circuit and in fluid communication with the chamber. At least one of the inlet and the outlet circuits comprises a progressively controllable valve so as to control flow rate in the inlet and outlet circuits, so as to modify the pressure at said end of the microchannel.

Document WO2018184971 relates to a microfluidic device comprising a tank supplying a microchannel with a first fluid, and a circuit in which a flow of a second fluid can be established without contact with the microchannel. The circuit passes through the tank or is connected to the tank by a pipe. The circuit comprises an on/off valve mounted in parallel with a proportional valve. The proportional and on/off valves are controllable so as to modify a pressure applied in the tank to the first fluid by the second fluid.

Document GB2569417 relates to a microfluidic drive system comprising a resonant piezoelectric gas pump comprising a substantially cylindrical cavity defined by cavity walls, the cavity having an inlet and an outlet aperture and a piezoelectric actuator arranged to generate oscillatory motion of the cavity walls to drive a gas between the inlet and outlet. A drive circuit is arranged to apply a voltage waveform across the piezoelectric actuator such that the oscillations of the cavity have a frequency of at least 500 Hz. Further, a microfluidic channel is arranged in fluid communication with the inlet or outlet of the pump such that, in use, the varying gas pressure provides a driving force to move a liquid through the microfluidic channel.

The above documents do not solve the abovementioned challenges and do not make it possible for a regulated pressure source to be adapted to many applications.

There is thus a need for a pressure or flow controlling apparatus and method with a fast response, absence of pulses, a small portable size, and the ability to deliver gas at a pressure as high as possible.

SUMMARY OF THE INVENTION

The invention relates to an apparatus for controlling pressure or flow in a fluidic system, the apparatus comprising:

- a first connection device comprising a pumping device and a main outlet, the first connection device being configured to be connected to a first gas source, the pumping device being configured to pump gas across said first connection device from the first gas source to the main outlet, or from the main outlet to the first gas source, and the main outlet being configured to be connected to said fluidic system or to a reservoir of fluid connected to said fluidic system;
- a second connection device comprising a flow restriction, the second connection device being configured to be fluidically connected to a second gas source and to the first connection device;
- a third connection device comprising a valve with a modifiable aperture, the third connection device being configured to be fluidically connected to a third gas source and to the first connection device;
- wherein the second connection device and the third connection device are connected to the first connection device at a position between the pumping device and the main outlet.

In some embodiments, one or more of the first, second, and third connection devices comprise a duct.

In some embodiments, the first, second and third gas sources are a common gas source, preferably the atmosphere.

In some embodiments, said pumping device comprises one or more piezoelectric pumps.

In some embodiments, the flow restriction is a passive flow restriction.

In some embodiments, said valve with a modifiable aperture is an on/off valve.

In some embodiments, the apparatus further comprises a control unit, the control unit comprising an electric driver system, preferably an electronic driver system.

In some embodiments, the apparatus further comprises one or more sensors, preferably comprising a flow meter and/or a pressure sensor, and the control unit being configured to receive input from one or more of the one or more sensors.

In some embodiments, the flow restriction has a flow resistance, and the flow resistance is more than one twentieth of a nominal ratio of the pumping device and less than half of the nominal ratio of the pumping device, said nominal ratio being the ratio ($Qmax/\sqrt{\Delta P}$) between a nominal flow rate (Qmax) of the pumping device and the square root of a nominal pressure head ($\Delta Pmax$) of the pumping device.

In some embodiments, the flow restriction has a flow resistance, and:

the flow restriction is a passive flow restriction, and the flow resistance of the flow restriction is such that the pressure at the main outlet of the apparatus, when said main outlet and the valve are closed, is lower by a factor from 2% and 15%, preferably from 3% to 10%, in the presence of said flow restriction, than the pressure at the main outlet of the apparatus, when said main outlet and the valve are closed and assuming that the flow restriction were fully closed; or the flow restriction is an active flow restriction, and the flow resistance of the flow restriction may be adjusted so that the pressure at the main outlet of the apparatus, when said main outlet and the valve are closed, is lower by a factor from 50% to 130%, preferably from 80% to 120%, in the presence of said flow restriction, than the pressure at the main outlet of the apparatus, when said main outlet and the valve are closed and assuming that the flow restriction were fully closed.

The invention also relates to an assembly comprising the above-described apparatus and a fluidic system, the fluidic system being fluidically connected to the main outlet of the apparatus; or comprising the above-described apparatus, a reservoir of fluid and a fluidic system, the reservoir being fluidically connected to the main outlet of the apparatus and the fluidic system being fluidically connected to the reservoir.

The invention also relates to a method of controlling pressure in a fluidic system, wherein said fluidic system is fluidically connected to the main outlet of the above-described apparatus, the method comprising adjusting one or more of said pumping device, said flow restriction, and said valve with a modifiable aperture.

The invention also relates to a method of controlling flow rate of a fluid in a fluidic system, wherein said fluidic system is fluidically connected to the main outlet of the above-described apparatus, or is fluidically connected to a reservoir of fluid, the reservoir being fluidically connected to the main outlet of the above-described apparatus, the method comprising adjusting one or more of said pumping device, said flow restriction, and said valve with a modifiable aperture.

In some embodiments, the valve with a modifiable aperture is significantly closed when said pumping device pumps gas across said first connection device from the first gas source to the main outlet, or from the main outlet to the first gas source and is significantly open otherwise.

The invention also relates to a non-transitory computer readable storage medium having stored thereon instructions that, when executed, cause at least one computing device to carry out the above-described method.

Embodiments of the present invention makes it possible to address the needs expressed above. In particular, the one or more embodiments provide an apparatus which makes it possible to efficiently control pressure or flow in a fluidic system. In addition, one or more embodiments provide a method of controlling pressure in a fluidic system fluidically connected to the main outlet of the apparatus. Further, embodiments provide a method of controlling flow rate of a fluid in a fluidic system, wherein the fluidic system is either directly fluidically connected to the main outlet of the apparatus or fluidically connected to a reservoir fluidically connected to the main outlet of the apparatus.

More particularly, the apparatus of the present invention is configured to be connected to a second and a third gas source via a flow restriction and a valve with a modifiable aperture, respectively. The combination of the flow restriction and the valve makes it possible to for example set a small gas leak when the pressure at the main outlet of the apparatus is sought to be increased or constant, and a large gas leak when the pressure at the main outlet of the apparatus is sought to be reduced again. Thus, the combination allows a fast response especially when the pressure in the fluidic system (or reservoir of fluid) should be reduced, while proving the ability to deliver gas at a pressure as high as possible when the pressure in the fluidic system (or reservoir of fluid) should be increased.

In particular embodiments of the invention, the combination of a passive flow restriction and an active on/off valve may be tuned to afford both stability and the shortest possible response time without significantly reducing the maximal pressure achievable. This combination is advantageous in reducing cost, reducing valve size, improving pump life (due to lower working regime) and reducing gas consumption. Gas consumption may be a particular concern when working with an expensive or dangerous gas, to avoid excessive leakage of the gas to the environment, or for portable devices in which power consumption and compactness are critical.

Some embodiments of the present invention also provide specific ranges of characteristics of the components of the apparatus, in particular, the flow restriction in order to achieve performances superior to those of the state of the art.

DESCRIPTION OF EMBODIMENTS

Embodiments of the invention will now be described in more detail without limitation in the following description.

Apparatus for Controlling Pressure or Flow

Figure 1:
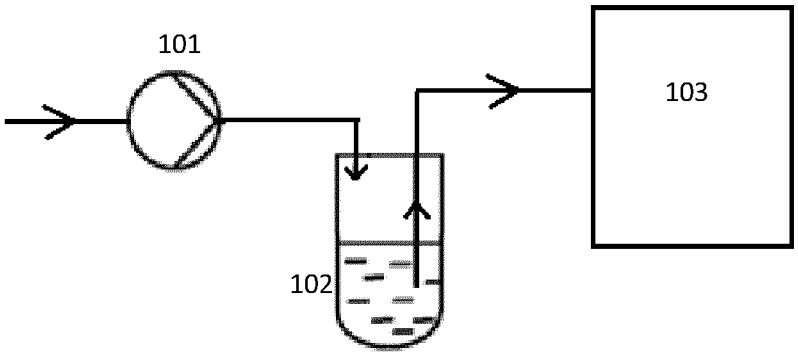
FIG. 1 shows a schematic diagram of a related assembly.

FIG. 1 shows a comparative assembly in which a pumping device 101 is fluidically connected to a reservoir 102 of fluid (e.g. liquid). The reservoir 102 is fluidically connected to a fluidic system 103. Such an assembly may be used to control an inflow of fluid to the fluidic system.

Figure 2:
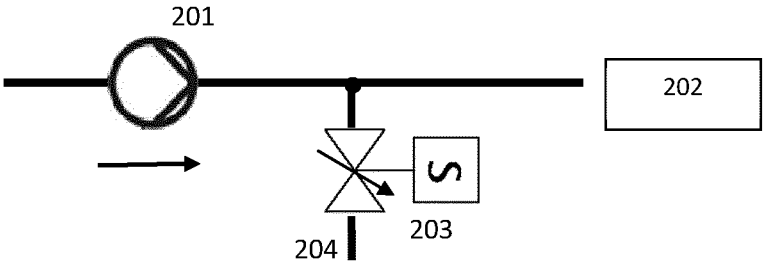
FIG. 2 shows a schematic diagram of a related assembly.

FIG. 2 shows a comparative assembly in which a pumping device 201 is fluidically connected to a fluidic system 202. The assembly also comprises a proportional valve 203 placed on a branch connected to the connection line 204 leading from the pumping device 201 to the fluidic system 202. The proportional valve mal allow a leakage of gas from the connection line 204.

Figure 3A:
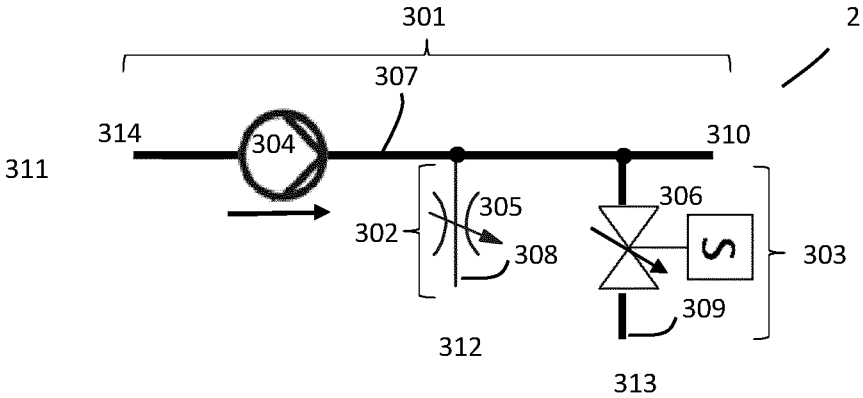
FIG. 3A shows a schematic diagram of an apparatus according to one embodiment of the present invention comprising a pump, a flow restriction and an on-off valve.
Figure 3B:
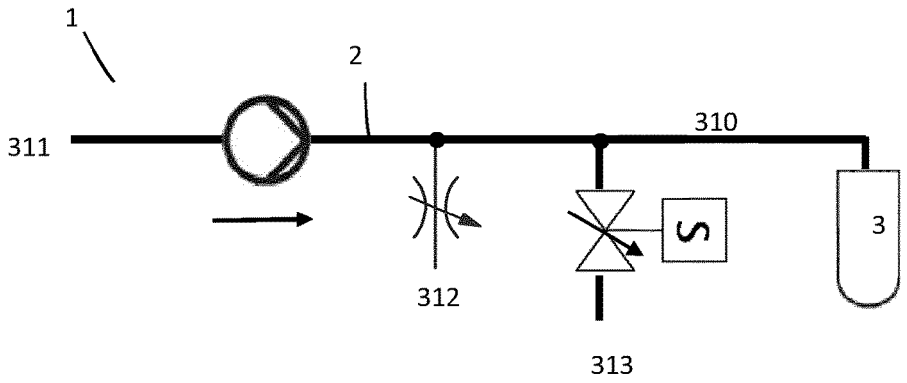
FIG. 3B shows a schematic diagram of an assembly comprising the apparatus of FIG. 3A.

One or more embodiments of the invention relate to an apparatus 2 as depicted in FIG. 3A-B for controlling pressure or flow in a fluidic system 3. A "fluidic system" designates a combination of one or more instruments associated to exert one or several tasks in relation to one or more fluids. By "instrument" is meant an integrated device that is able to perform at least one function without the addition of additional components other than components available in the operational environment, such as for instance an energy source, or consumables. A fluidic system may comprise at least one channel but optionally comprises other components. A fluidic system may comprise components which are fluidic in their nature and/or function. Fluidic systems may involve different levels of integration. For instance, they can be restricted to a single fluidic chip or component, integrating one or several functionalities. Fluidic systems used in the invention may also comprise other kinds of elements and components, some of which explicitly described here, such as pumps, valves, sensors, actuators, detectors, and many others known in the art, which are encompassed within the field of the invention. In particular, fluidic systems may also be full instruments and integrate for instance any of holders, housings, power sources, control software and hardware, communication means, storage means, manipulation means, human-machine interfaces.

The fluidic system may notably be a microfluidic, millifluidic, or nanofluidic system or any combination thereof. By "millifluidic system" is meant a fluidic system in which the minimal channel dimension is of the order of 1-10 mm. By "microfluidic system" is meant a fluidic system in which the minimal channel dimension is of the order of 1 to less than 1000 μm. By "nanofluidic system" is meant a fluidic system in which the minimal channel dimension is of the order of less than 1 μm.

By "fluidic chip" or equivalently "chip", or equivalently "fluidic component", is meant an object comprising at least one channel, or at least one combination of channels. The channel or combination of channels are embedded at least in part in a matrix. Fluidic chips or devices may be microfluidic chips or devices, i.e., comprise at least one microchannel. Fluidic chips or devices may be millifluidic chips or devices, i.e., comprise at least one millichannel. Fluidic chips or devices may be nanofluidic chips or devices, i.e., comprise at least one nanochannel. Fluidic chips or devices may be any combination of millichannels, nanochannels or microchannels.

The apparatus 2 comprises a first connection device 301. The first connection device 301 comprises a pumping device 304 which is configured to pump gas across said first connection device 301. In some embodiments, the first connection device 301 may comprise a duct 307.

The apparatus 2 further comprises a second connection device 302 which itself comprises a flow restriction 305. In some embodiments, the second connection 302 device may comprise a duct 308.

The flow restriction 305 may be an active flow restriction. By active flow restriction is meant a flow restriction with a flow resistance which is modifiable by an operator and/or by a driver system during the operation of the apparatus of the invention. In particular, an active flow restriction may have a flow resistance that can be modified as a response to a measurement performed by one or more sensors within or connected to the apparatus of the invention, or as a response to a target set by the user, or as a response to the operation of a software driving the driver system. Non-restrictive examples of active flow restrictions may be any kind of driven valve, such as for instance electro valves, proportional valves, pinch valve, magnetically, piezoelectrically or pneumatically actuated valves.

In some preferred embodiments, the flow restriction 305 may be a passive flow restriction. By passive flow restriction is meant a flow restriction that is kept to a fixed flow resistance value during a whole experiment, or a whole session of operation of the apparatus of the invention. In particular, a passive flow restriction may have a flow resistance value that is not controlled, i.e., modified by a driver system during said session. Non-restrictive examples of passive flow restrictions are a capillary and a manual needle valve. In some embodiments, passive flow restrictions in the invention may be tunable, as long as they are set to a fixed value during a session of operation.

Using passive flow restriction has the advantage of providing a very stable and reproducible flow resistance, thereby to achieve an accurate and stable operation. In some applications, for instance and non-limited to, when the apparatus has a large range of applications with very different flow rates and/or pressures, the better tunability of an active flow restriction may be preferable.

The apparatus 2 further comprises a third connection device 303 comprising a valve with a modifiable aperture 306. In some embodiments, the third connection device may comprise a duct 309.

The valve with a modifiable aperture may an on/off valve. An on/off valve is equivalently referred to as a bimodal valve.

The first connection device 301 of the apparatus 2 further comprises a main outlet 310 configured to be connected to said fluidic system 3.

The first connection device 301 is configured to be fluidically connected to a first gas source 311. More specifically, the first connection device 301 has an inlet connected to the first gas source 311.

The second connection device 302 is configured to be fluidically connected to a second gas source 312. More specifically, the second connection device 302 has a second outlet connected to the second gas source 312.

The third connection device 303 is configured to be fluidically connected to a third gas source 313. More specifically, the third connection device 303 has a third outlet connected to the third gas source 313.

The first connection device 301, second connection device 302 and third connection device 303 are fluidically connected. For example, the second connection device 302 may comprise a duct connected as a branch to the duct of the first connection device 301. Similarly, the third connection device 303 may comprise a duct connected as a branch to the duct of the first connection device 301. The second connection device 302 and the third connection device 303 are connected to the first connection device 301 at a position between the pumping device 304 and the main outlet 310.

Alternatively, the second connection device 302 can be a mere passage directly positioned on the duct of the first connection device 301 (between the inlet and the main outlet) and ensuring a fluidic connection to the second gas source.

The main outlet 310 is therefore fluidically connected to the first gas source 311 via said first connection device 301, to a second gas source 312 via said first connection device 301 and second connection 302; and to a third gas source 313 via said first connection device 301 and third connection device 303.

By A being "fluidically connected" to B, is meant that there is a particular state of the connection device(s) that allows a fluid flow of gas between A and B. For example, the valve with a modifiable aperture allows a flow of gas if it is not positioned in the fully closed state.

In some embodiments, any of said first, second, and third connection devices may comprise a duct. Any of said pumping device 304, said flow restriction 305, and said valve with modifiable aperture 306 may be positioned in the path of a respective duct. The size and material of the duct may be chosen according the well-known practice and/or standard.

According to some embodiments, the pumping device 304 is able to operate in a controllable range of output flow and/or pressure. According to some embodiments, said pumping device comprise one or more piezoelectric pumps. According to some embodiments, said pumping device comprises a resonant pump. According to some other embodiments, said pumping device may comprise a pump of another type or combination of pumps of other types, such as turbine pumps, peristaltic pumps, piston pumps, or membrane pumps. The choice between these different types of pumps may be made as known in the art to make the best compromise, for each application, between size, weight, cost, power consumption, type of power source (e.g. AC or battery), and maximum pressure and flow rate needed for a given application of the apparatus.

According to some embodiments, the pumping device 304 may be configured to pump gas from said first gas source 311 to said fluidic system 3, via said main outlet 310. In some preferred embodiments, the apparatus 2 is configured to increase the pressure at the main outlet 310 and the fluidic system 3, i.e., to pressurize. During pressurizing, the gas may significantly flow to the main outlet 310 and enter the fluidic system 3. During pressurizing, the gas may also flow, i.e., "leak" to one or more of said second gas source 312 and third gas source 313 depending on the state of said second connection device 302 and third connection device 303.

According to some embodiments, the pumping device 304 may be configured to pump gas via said main outlet 310 from said fluidic system 3 to said first gas source. In some preferred embodiments, the apparatus is configured to decrease the pressure at the main outlet and the fluidic system 3, i.e., to depressurize. During depressurizing, the gas may significantly flow, i.e., "leak" to one or more of said second and third gas sources depending on the state of said second and third connection devices.

The pressurizing and the depressurizing may be combined according to some other embodiments in which said pumping device 304 may be configured to pump gas from the inlet 314 via the main outlet 310 to said fluidic system 3, or from said fluidic system 3 via the main outlet 310 to the inlet 314, depending on a signal received from a drive system. For example, pressurizing and depressurizing may be combined according to some embodiments to provide a specific pressure profile at the main outlet 310 of the apparatus. The specific pressure may be constant pressure.

In some embodiments said first 311, said second 312, and said third gas source 313 may be sources of air, or of a different gas. Using different gases may be employed according to some well-known practice and standards not to exhaust a hazardous gas in the atmosphere. Each gas source 311, 312, 313 may be either the atmosphere, or a container containing a gas.

In some other embodiments, any of said first, said second, and said third gas source may comprise several gases and/or may include a plurality of gas containers.

According to some embodiments, the first 311, the second 312, and the third gas source 313, or any combination between gas sources 311, 312 and 313 are a same gas source. In some preferred embodiments the said common gas source is the atmosphere.

In other embodiments, the first gas source 311 can be a gas container (preferably containing a gas other than air), while the second and third gas sources 312, 313 are the atmosphere.

In some embodiments first 301, second 302, and third connection device 303 comprises at least a duct positioned in a parallel configuration to each other. The specific components, their precise location and configuration of fluidic paths may vary according to a given application according to embodiments of the present invention.

Control of the Pressure and/or Flow Rate

At least one embodiment of the invention also relates to a method of controlling pressure and/or flow rate in a fluidic system 3 which is discussed with reference to FIG. 3 and FIG. 6. The method of controlling pressure controls the pressure in a fluidic system 3, when said fluidic system 3 is fluidically connected to the main outlet 310 of an apparatus 2 of the invention. The method comprises adjusting one or more of said pumping device 304, said flow restriction 305, and said valve with modifiable aperture 306. The method of controlling flow rate controls the flow rate of a fluid in a fluidic system 3 when said fluidic system 3 is fluidically connected to the main outlet 310 of an apparatus 2 of the invention or fluidically connected to a reservoir of fluid (e.g., liquid), the reservoir being fluidically connected to the main outlet 310 of an apparatus 2 of the invention. The method comprises adjusting one or more of said pumping device 304, said flow restriction 305, and said valve with modifiable aperture 306.

In some embodiments, the fluidic system 3 may be connected by at least one of its fluidic ports, to the main outlet 310 of an apparatus 2 of the invention. In some preferred embodiments, the fluidic system 3 is connected to a reservoir containing a liquid, said reservoir being additionally connected to the main outlet 310 of an apparatus 2 of the invention. Said fluidic system may be connected by at least another of its port to a gas or liquid source at a pressure different from the pressure at the main outlet 310 of said apparatus.

The method of controlling the pressure and the method of controlling the flow rate may be applied on a same fluidic system 3 at the same time.

In some preferred embodiments one or more of the pumping device 304, the valve with a modifiable aperture 306, and the flow restriction 305, or any combination thereof, are controlled by a driver system. In some preferred embodiments, both the pumping device 304 and the valve with a modifiable aperture 306 are controlled by a single driver system. The driver system may be an electric, or preferably electronic, driver system.

When the flow restriction is an active flow restriction, the active flow restriction may be controlled by an electronic driver system. Preferably, said electronic driver system also controls the pumping device along the first path. The set of one or more driver systems may be equivalently referred to as the control unit.

Figure 6:
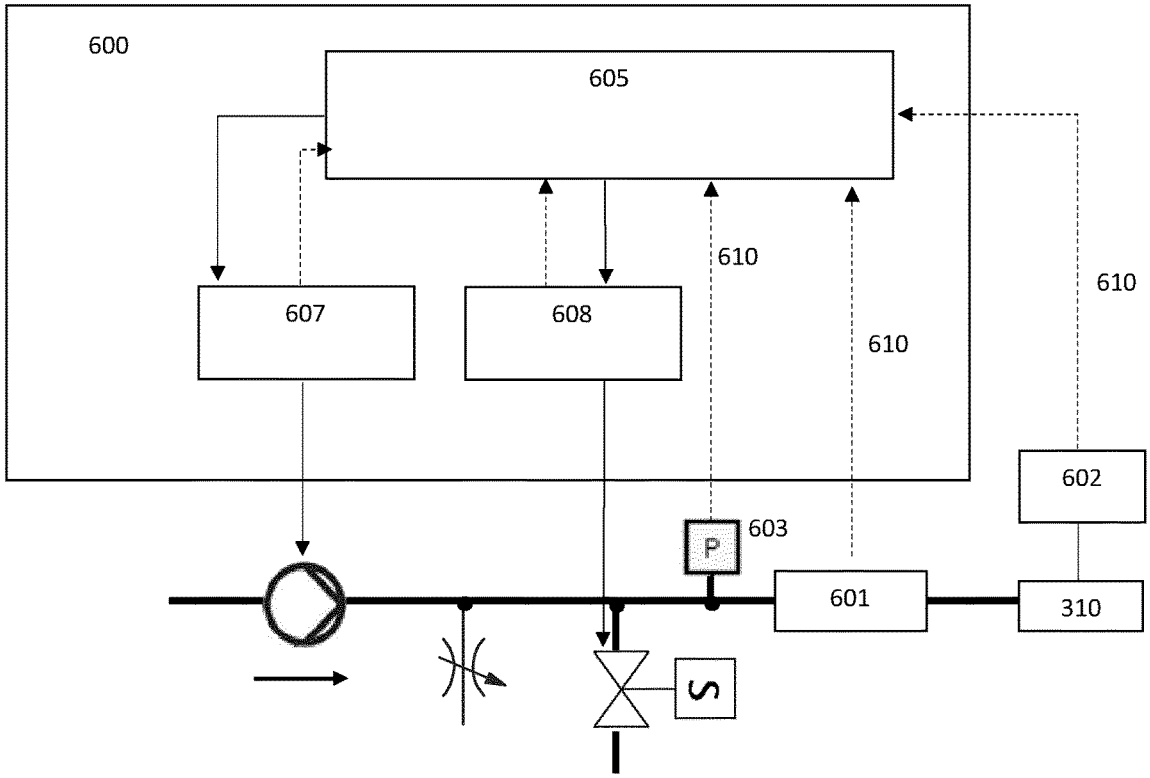
FIG. 6 shows a schematic diagram of an embodiment of an apparatus, including a drive system.

In reference to FIG. 6, in examples, the apparatus may also comprise a control unit 600. The control unit 600 makes it possible for a user to control one or more of the parameters of the flow rate and the pressure at the main outlet 310 of the apparatus 2. The control unit may comprise a graphical user interface which allows to choose an input value for one or more than one parameter.

The control unit 600 may ensure a fully automated operation of the apparatus 2 and assembly 1.

The control unit may comprise one or more processors or microprocessors 605 coupled to a storage medium, as well as a computer program comprising instructions stored thereon, for performing various steps described in more detail below. The control unit may comprise any of an electronic board, a computer, a microprocessor, or a manual controller.

The control unit 600 may be configured to receive input 610 from any combination of one or more sensors, including pressure sensors and/or flow meters, as well as input from the user. The one or more pressure sensors and/or flow meters may be within the apparatus of invention or connected to it.

In particular, the control unit may be configured to receive input from one or more flow meters, such as: a flow meter 601 at the main outlet 310 of the apparatus, a flow meter on the second connection device 302, a flow meter on the third connection device 303, and/or a flow meter at the inlet 314 of the apparatus (or between the inlet 314 and the pumping device 304).

The control unit may be configured to receive input from one or more pressure sensors, such as: a pressure sensor 603 at the main outlet 310 of the apparatus, a pressure sensor on the second connection device 302, a pressure sensor on the third connection device 303, and/or a pressure sensor at the inlet 314 of the apparatus (or between the inlet 314 and the pumping device 304). In some preferred embodiment, sensors are positioned close to the main outlet 310 to be less impacted by the fluctuations after the pump.

The control unit 600 may be also configured to receive input from any other pressure sensor, flow meter, light sensor, pH sensor, camera, current or voltage sensor which may be present in the assembly 1, within the apparatus or not, such as an external pressure sensor 602. The sensors may in particular be located in or associated with the fluidic system.

The control unit may process the input data and/or the user instructions and as a result, provide instructions to the various control valves and pressure controllers, and in particular to one or more of a flow resistance of the flow restriction 305, a power of the pumping device 304 and an opening of the valve with a modifiable aperture 306. The control unit 600 may comprise one or more sections each configured to control a particular part of the apparatus 2. For example, the control unit 600 may comprise a section 606 (not shown) to control the flow resistance of the flow restriction 305 and/or a section 607 to control the power of the pumping device 607 and/or a section 608 to control the opening of the valve with modifiable aperture 306.

The control unit may provide the instructions according to any known regulation algorithm in the field of control engineering to correspond one or more of the pressure or the flow rate to the user instructions, for example a desired pressure or flow rate profile at the main outlet of the apparatus. In some preferred embodiments, the regulation algorithm involves a closed loop configuration. The regulation algorithm may be of the proportional type (P), integral type (I), derivative type (D), proportional-integral type (PI), proportional-derivative type (PD), integral-derivative type (ID), preferably proportional-integral-derivative type (PID) or any other known algorithms in the control theory comprising linear models, deterministic system control, fuzzy logic, and machine-learning.

In some examples, the control unit may control the flow resistance of the flow restriction. If the flow restriction is a passive flow restriction the control unit or the user may tune the flow restriction to a fixed value at the beginning of a session of operation. Additionally, or alternatively, the tuning of the passive flow restriction may be set before its first usage and remains unchanged during its working life. The flow resistance of active flow restrictions, such as proportional valves, may be tuned depending on their drive voltage. Alternatively, the active flow restriction may be a pneumatically actuated valve, or a mechanically actuated valve. In some embodiments, the control unit may set the flow resistance of the flow restriction to obtain the optimum performances and/or the response time. The method to determine the leak factor corresponding to the optimum performance and/or the response time is discussed below.

Figure 7:
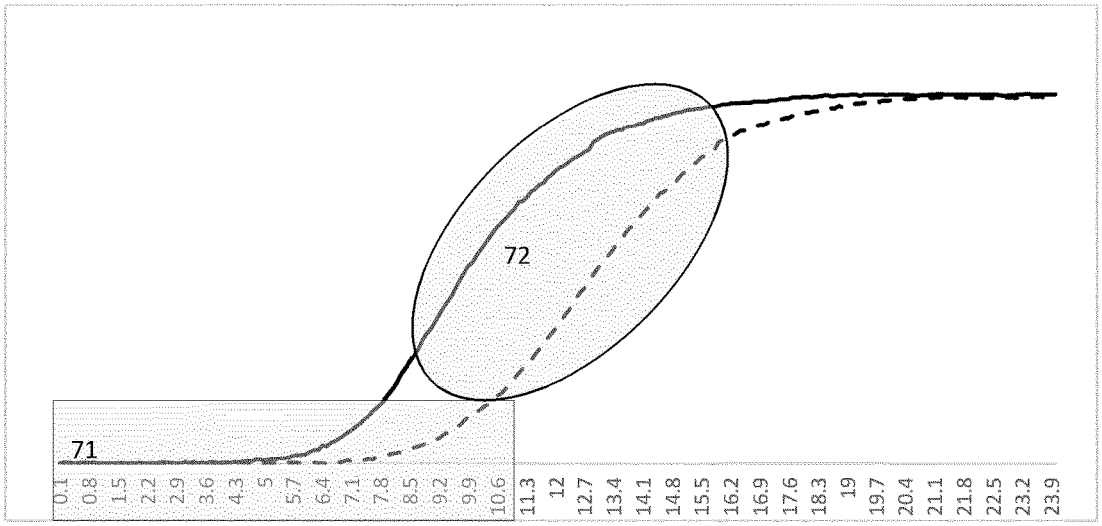
FIG. 7 presents an example of flowrate through two proportional valves of same reference depending on the drive voltage. The flowrate at the proportional valve can be read on the Y-axis and the drive voltage can be read on the X-axis.

Active flow restrictions, like proportional valves, have some technical limitations to be controlled. Active flow restrictions command came with hysteresis and are also subject to environmental conditions such as temperature variations and humidity. For example, proportional valves are not ideal, and their flow resistance is not linear to the drive voltage. In addition, pressure differential applied to a proportional valve may change the opening threshold. Further, opening threshold of the proportional valves may vary even among valves of the same model; those variations can be significant, up to more than 30% of the full scale. This leads to irreproducible flow resistance as presented in FIG. 7 which represents flowrate through a proportional valve depending on drive voltage for two proportional valves of a same model. Due to those factors controlling a small opening region 71 for a proportional valve is an uncertain region and difficult to manage. A more common practice is to work above opening threshold 71 and in a region of linearity 72 which leads to a larger gas leak while at low regime.

In some preferred embodiments, the apparatus may be operated as follows:

- the valve with a modifiable aperture may be significantly closed while the pumping device is pressurizing a connected fluidic system; and/or
- the valve with a modifiable aperture may be significantly open and the pumping device may be shut off, so as to decrease the pressure at the main outlet; and/or
- the valve with a modifiable aperture may be closed while the pumping device is maintaining a constant pressure at the main outlet; and/or
- the valve with a modifiable aperture may be open and the pumping device may be operated at the end of a pressure transition in order to allow smoother transitions.

Operating the pumping device while the valve is opened forms a more tuneable system. Having both the valve open and the pump operated at the same time is also useful when operating at the bounds of the achievable pressure range, i.e., near minimal or near maximal pressure. At low pressure, the valve can always remain opened since small variations on the pumping device generate high relative variations of pressure. Similarly, at high pressure, when the valve is opened, it generates a significant pressure drop that can be attenuated by keeping the pumping device operating.

One preferred mode of operation comprises:

- having the valve with a modifiable aperture significantly open (preferably having the on/off valve open) when the pressure at the main outlet is not comprised between the pressure at the main inlet and the target pressure; and
- having the valve with a modifiable aperture closed (preferably having the on/off valve closed) when the pressure at the main outlet is comprised between the pressure at the main inlet and the target pressure.

Valve Qualification

The invention further proposes specific ranges of characteristics of its components, to achieve performances superior to those of the state of the art. Some embodiments of the invention may provide specific ranges of characteristics for a passive or an active flow restriction, in particular, for the flow restriction and the valve with a modifiable aperture. Depending on being active or passive flow restriction, the characteristic may be enforced by the control unit as discussed above during the operation session or being set at the beginning of the operation session without any further modification during the operation.

The invention further relates to a method of determining a dimensionless leak factor coefficient. This factor is relative to pump capabilities and offers a convenient method to determine the influence of the leak from the system (to the second and third gas sources 312, 313) on the pressure drop, flowrate and response time. Finally, this factor can be converted into a flow resistance property of a valve or aperture, taking into account pump capabilities. Additionally, this factor provides a way to adjust a leak by measuring flowrate or maximal pressure.

Any of the method of controlling the pressure and the method of controlling the flow rate discussed above may adjust the flow resistance of the flow restriction Kv such that $$\frac{1}{20}\frac{Q\max}{\sqrt{\Delta P\max}} \le Kv \le \frac{1}{2}\frac{Q\max}{\sqrt{\Delta P\max}}$$

where Qmax is a nominal flow rate of the pumping device, and ΔPmax is a nominal pressure difference of the pumping device, also known as the nominal head. Hereinafter, the pressure is considered relative to a standard condition, e.g., the atmosphere pressure, thus the notation Pmax may be equivalently used as ΔPmax. The flow resistance Kv is equivalently called the discharge coefficient and is directly linked to the area of the orifice representing the valve. The nominal pressure difference and flow rate may be the maximal achievable pressure difference and flowrate of the pumping device, respectively. The ratio of these two values, Qmax/√ΔPmax, may be referred to as a nominal ratio Rn of the pumping device.

In some preferred embodiments, Kv/Rn should be between ½ and 1/10, or, on in some other embodiments, between 1 and 1/100.

According to preferred embodiments, the first gas source, the second gas source, and the third gas source are a same gas source, and hereinafter the pressure difference at the flow restriction, i.e., the pressure drop before and after the flow restriction is considered to equal the pressure difference before and after the pumping device ΔP. In preferred embodiments, the gas is an ideal gas approximately governed by ideal gas law PV=nRT and in subsonic regime. If thermodynamic effects are not effective the relationship $$Qleak = Kv\sqrt{\frac{\Delta P}{SG}}$$

links flowrate Qleak at the flow restriction, flow resistance Kv and pressure difference ΔP at the flow restriction, i.e., the pressure drop before and after the flow restriction. T SG is the specific gravity of the gas. The unit of the discharge coefficient is $m^3$/hour when Q is expressed in $m^3$/hour and pressure in bar.

In some preferred embodiments, the gas is air. The specific gravity of the air at 20° C. is 1, thus Qleak=Kv√ΔP.

In some preferred embodiment, Kv should match the pump flowrate and Q and $\sqrt{\Delta P}$ characteristics such that the response time during pressurization and depressurization are at least significantly equal. A discharge coefficient greater than $Q/\sqrt{\Delta P}$max degrades the pump performance while an excessively small discharge coefficient leads to long depressurization time compared to pressurisation time.

If the main outlet 310 of the apparatus 2 is connected to a gas reservoir 4, for example in reference to FIG. 6, the response time is affected by the volume of the reservoir. Assuming isothermal conditions, the dynamics of the pressure in the reservoir can be expressed by dP/dt=dn/dt RT/V, where Qn=dn/dt is the molar flow rate. Thus, the response time of the fluidic system is proportional to reservoir volume.

Figure 8:
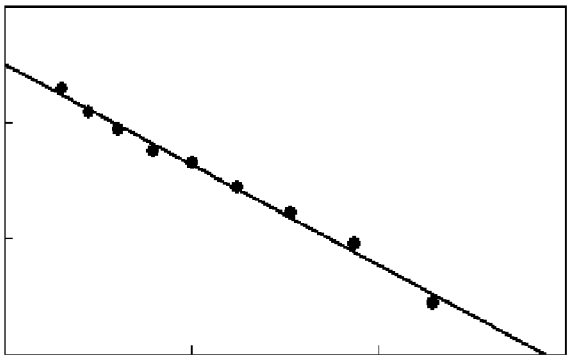
FIG. 8 illustrates a typical relationship between maximal achievable pressure (X-axis) and flowrate (Y-axis) of a pump.

In examples wherein the pumping device system contains one pump, without the leak in the second and the third outlet, the relationship between pump pressure difference and flow rate may considered to be linear as presented in FIG. 8 by an expression $$Q\text{pump}=\alpha(1-\Delta P/\Delta P\text{max})$$

where α is a pump characteristic and Pmax the maximal pressure achievable by the pump in case of absence of the leak through the second outlet and the third outlet.

When a leak is introduced, total flow through the reservoir is expressed by Q=Qpump−Qleak where Qleak=Kv$\sqrt{\Delta P}$. The larger the pressure in the reservoir, the larger the flowrate leak is and the lower the flowrate provided by the pump is. An equilibrium may be met at a certain pressure which is lower than the pump maximal pressure. Although a leak allows faster depressurization, it lowers system flowrate leading to slower response time during pressurization.

Notably, a leak factor F(P,Q) can be considered where P and Q are the pressure and flowrate of the pumping device. This factor is dimensionless and is directly linked to pump achievable performances (maximal pressure and maximal flowrate). The leak factor may be presented as the formula $$F = \frac{Qleak}{\sqrt{\Delta P}} \frac{\sqrt{\Delta P\text{max}}}{Q\text{max}}$$

where Qleak is the flowrate through the leak and $\sqrt{\Delta P}$ is the differential pressure applied to the leak. The constant used for leak factor formula is expressed by $\sqrt{\Delta P}$max/Qmax and is equal to the to inverse of the nominal ratio Rn of the pumping device. Its value is determined at two working regimes: without load maximal flowrate is measured, with a closed reservoir at pump outlet maximal achievable pressure is measured. This is only used for deducing leak factor dimensionless value and has no physical signification. As the leak factor is dimensionless, it can be used to characterize any pneumatic system with a leak.

The influence of the leak factor F on the maximal achievable pressure and flowrate of the leak can be deduced from previous equations as $$F = \frac{Qleak}{\sqrt{Pleak}} \frac{\sqrt{\Delta P\text{max}}}{Q\text{max}},$$

and considering a static regime where Qleak=Qmax(1−ΔPleak/ΔPmax). ΔPleak represents the maximal achievable pressure of the system, which is lower than Pmax which is the maximal pressure of the pump without leak. By static regime is meant a regime of operation of the pumping device which is defined by a constant pressure and flowrate at system output. In the static regime, there is no variation of pressure or flow and there are no transitory effects such as thermal relaxation. In other terms system is at equilibrium. The static regime is in contrast to a dynamic regime. The equation for Pleak is a quadratic equation and Pleak may be obtained via a standard formula as $$Pleak = \frac{-\frac{FQ * Q\text{max}}{\sqrt{\Delta P\text{max}}} + \sqrt{\left(\frac{F * Q\text{max}}{\sqrt{\Delta P\text{max}}}\right)^2 + 4\left(\frac{Q\text{max}^2}{\Delta P\text{max}}\right)}}{2\frac{Q\text{max}}{\Delta P\text{max}}}.$$

The corresponding Qleak or the flow through the leak is then obtained by $$Qleak = \frac{F * \sqrt{Pleak} * Q\text{max}}{\sqrt{\Delta P\text{max}}}.$$

Table 1 shows the influence of the leak factor F on the maximal system pressure and maximal flow through the leak:

TABLE 1

| F | Pleak (% of Pmax) | Qleak (% of Qmax) |
|---|---|---|
| 0 | 100 | 0 |
| 0.05 | 95 | 4.8 |
| 0.1 | 90 | 9.5 |
| 0.2 | 80 | 17.9 |
| 0.5 | 60 | 38.7 |
| 0.75 | 47.5 | 51.7 |
| 1 | 38 | 61.6 |
| 1.5 | 27.5 | 78.7 |

The leak factor F also impacts the depressurization response time. Flow through small leak is low resulting in more time required for pressure to decrease. Higher flowrate through the leak improves response time. Response time may be expressed as a function of $$P(t) = P\text{max}\left(1 - e^{\frac{t}{\tau}}\right).$$

A leak factor F of 1 (100%) allows the same response time during pressurization and depressurization. Increasing this factor will profit depressurization time at the cost of lowering maximal achievable pressure. Decreasing this factor will increase response time during depressurization but also allow higher achievable pressure. A leak factor over 1.5 (150%) might lead to system instabilities.

The leak factor F may be defined both for the flow restriction and for the valve with a modifiable aperture.

For any given leak outlet (flow restriction or valve), if the pressure at the main outlet of the apparatus, when all outlets except the leak outlet are closed, is lower by an amount of X % than the pressure at the main outlet of the apparatus, when all outlets including the leak outlet are closed; then the leak factor F of the leak outlet is X % (or is X. $10^{-2}$).

More specifically, the leak factor F of the flow restriction 310 in the apparatus 2 described above is defined as follows. If the pressure at the main outlet 310 of the apparatus 2, when said main outlet 310 and the valve with a modifiable aperture 306 are closed, is lower by an amount of X % than the pressure at the main outlet 310 of the apparatus 2, when said main outlet 310 and the valve with a modifiable 306 are closed and assuming that the flow restriction 305 were fully closed; then the leak factor F of the flow restriction 305 is X % (or is X. $10^{-2}$). This leak factor F may be defined for a passive flow restriction or an active flow restriction.

The leak factor F for the flow restriction may e.g. range (i.e. may be preset or may be actively adjusted to) from 1 to 5%; or from 5 to 10%; or from 10 to 15%; or from 15 to 20%; or from 20 to 25%; or from 25 to 30%; or from 30 to 35%; or from 35 to 40%; or from 40 to 50%; or from 50 to 60%; or from 60 to 70%; or from 70 to 80%; or from 80 to 90%; or from 90 to 100%; or from 100 to 110%; or from 110 to 120%; or from 120 to 130%. In particular it may range from 10 to 50% and ideally around 25%.

Similarly, the leak factor F of the valve with a modifiable aperture 306 in the apparatus 2 described above is defined as follows. If the pressure at the main outlet 310 of the apparatus 2, when said main outlet 310 and the flow restriction 305 are closed, is lower by an amount of X % than the pressure at the main outlet 310 of the apparatus 2, when said main outlet 310 and the flow restriction 306 are closed and assuming that the valve with a modifiable aperture 306 were fully closed; then the leak factor F of the valve with a modifiable aperture 306 is X % (or is X. $10^{-2}$).

The leak factor F for the valve with a modifiable aperture (especially the on/off valve) may e.g. range from 1 to 5%; or from 5 to 10%; or from 10 to 15%; or from 15 to 20%; or from 20 to 25%; or from 25 to 30%; or from 30 to 35%; or from 35 to 40%; or from 40 to 50%; or from 50 to 60%; or from 60 to 70%; or from 70 to 80%; or from 80 to 90%; or from 90 to 100%; or from 100 to 110%; or from 110 to 120%; or from 120 to 130%. In particular it may range from 50 to 130% and ideally around 100%.

The leak factor F may be determined upstream in order to achieve a desired system performance, for example the maximal achievable pressure, the shortest response time, the maximal flow, and/or system efficiency. Alternatively, the leak factor can also be measured downstream in order to check system performances.

The leak factor F may be used as a tool to manually adjust a passive flow restriction in the apparatus or to determine an ideal flow resistance for an active flow restriction in order to reach a desired performance in the apparatus. In particular, a desired performance can be reached when the system is symmetrical, i.e., has the same pressurisation/depressurization time. therefore, one ideal leak factor may be 100%. Similarly, the leak factor may be used to optimize the performance for embodiments having a combination of a passive flow restriction and an on/off valve, by providing a small leak for the passive flow restriction and high on/off valve leak.

Therefore, in some embodiments, the leak factor for the flow restriction, especially if the flow restriction is an active flow restriction, is from 50% to 130%, preferably from 80% to 120%, more preferably from 90% to 110% and ideally is approximately 100%. The leak factor may be adjusted by properly calibrating the active flow restriction.

In some embodiments, the leak factor for the flow restriction, especially if the flow restriction is a passive flow restriction, is from 2% to 15%, preferably from 3% to 10%, more preferably from 4% to 7% and ideally is approximately 5%. This is especially advantageous when the valve with a modifiable aperture is an on/off valve.

Figure 12:
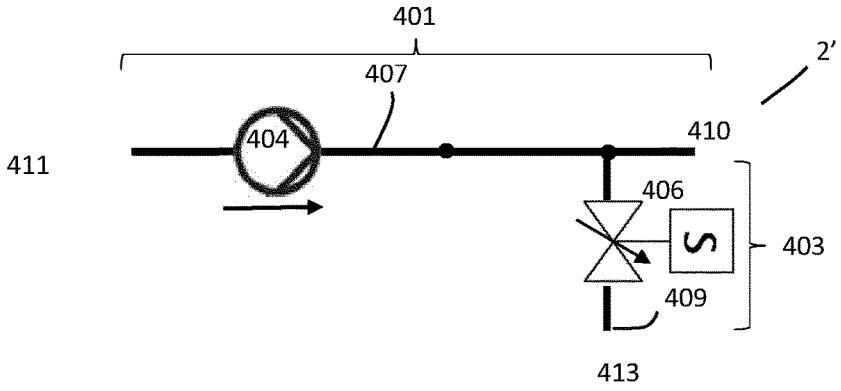
FIG. 12 shows a schematic diagram of an apparatus according to another aspect of the present invention comprising a pump and an on-off valve.

According to another aspect, and making reference by way of illustration to FIG. 12, the invention relates to the following items:

1. An apparatus 2' for controlling pressure or flow in a fluidic system, the apparatus 2' comprising:
   - a main connection device 401 comprising a pumping device 404 and a main outlet 410, the first connection device 401 being configured to be connected to a main gas source 411, the pumping device 404 being configured to pump gas across said first connection device 401 from the main gas source 411 to the main outlet 410, or from the main outlet 410 to the main gas source 411, and the main outlet 410 being configured to be connected to said fluidic system or to a reservoir of fluid connected to said fluidic system;
   - a secondary connection device 403 comprising an on/off valve 406, the secondary connection device 403 being configured to be fluidically connected to a secondary gas source 413 and to the main connection device 401;

wherein the secondary connection device 403 is connected to the main connection device 401 at a position between the pumping device 404 and the main outlet 410.
2. The apparatus 2' of item 1, wherein one or both of the main and secondary connection devices 401, 403 comprise a duct 407, 409.
3. The apparatus 2' of any of items 1 or 2, wherein the main and secondary gas sources 411, 413 are a common gas source, preferably the atmosphere.
4. The apparatus 2' of any of items 1 to 3, wherein said pumping device 404 comprise one or more piezoelectric pumps.
5. The apparatus 2' of any of items 1 to 4, wherein the apparatus 2' further comprises a control unit, the control unit comprising an electric driver system, preferably an electronic driver system.
6. The apparatus 2' of item 5, wherein the apparatus 2' further comprises one or more sensors, preferably comprising a flow meter and/or a pressure sensor, and the control unit being configured to receive input from one or more of the one or more sensors.
7. The apparatus 2' of any of items 1 to 6, wherein the pressure at the main outlet 410 of the apparatus 2', when said main outlet 410 is closed, is lower by a factor from 50% to 130%, preferably from 80% to 120%, when the on/off valve 406 is open, than the pressure at the main outlet 410 of the apparatus 2', when said main outlet 410 and the on/off valve 406 are closed.
7. An assembly comprising the apparatus 2' of any one of items 1 to 8 and a fluidic system, the fluidic system being fluidically connected to the main outlet 410 of the apparatus 2'; or comprising the apparatus 2' of any one of items 1 to 7, a reservoir of fluid and a fluidic system, the reservoir being fluidically connected to the main outlet 410 of the apparatus 2' and the fluidic system being fluidically connected to the reservoir.
8. A method of controlling pressure in a fluidic system, wherein said fluidic system is fluidically connected to the main outlet 410 of an apparatus 2' according to any of items 1 to 7, the method comprising adjusting one or both of said pumping device 404 and said on/off valve 406.

9. A method of controlling flow rate of a fluid in a fluidic system, wherein said fluidic system is fluidically connected to the main outlet 410 of an apparatus 2' according to any of items 1 to 7, or is fluidically connected to a reservoir of fluid, the reservoir being fluidically connected to the main outlet 410 of an apparatus 2' according to any of items 1 to 7, the method comprising adjusting one or both of said pumping device 404 and said on/off valve 406.
10. The method of item 8 or 9, wherein the on/off valve 406 is closed when said pumping device 404 pumps gas across said main connection device 401 from the first gas source 411 to the main outlet 410, or from the main outlet 410 to the first gas source 411 and is significantly open otherwise.
11. A non-transitory computer readable storage medium having stored thereon instructions that, when executed, cause at least one computing device to carry out the method of any one of items 8 to 10.

In this aspect, the apparatus is preferably devoid of a connection device comprising a flow restriction. Other than that, the entire above description applies similarly to this aspect (the main connection device corresponding to the above first connection device and the secondary connection device corresponding to the above third connection device).

The apparatus according to this aspect of the invention provides a way to control pressure or flow rate in a system with a short response time, and with limited or no hysteresis.

Figure 13:
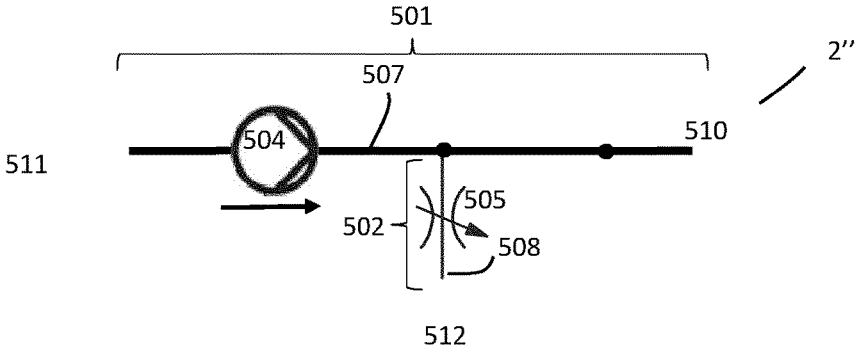
FIG. 13 shows a schematic diagram of an apparatus according to yet another aspect of the present invention comprising a pump and a flow restriction.

According to yet another aspect, and making reference by way of illustration to FIG. 13, the invention relates to the following items:

1. An apparatus 2" for controlling pressure or flow in a fluidic system, the apparatus 2" comprising:
   a main connection device 501 comprising a pumping device 504 and a main outlet 510, the main connection device 501 being configured to be connected to a first gas source 511, the pumping device 504 being configured to pump gas across said first connection device 501 from the first gas source 511 to the main outlet 510, or from the main outlet 510 to the first gas source 511, and the main outlet 510 being configured to be connected to said fluidic system or to a reservoir of fluid connected to said fluidic system;
   a secondary connection device 502 comprising a flow restriction 505, the second connection device 502 being configured to be fluidically connected to a second gas source 512 and to the first connection device 501;

wherein the secondary connection device 502 is connected to the main connection device 501 at a position between the pumping device 504 and the main outlet 510.

2. The apparatus 2" of item 1, wherein the main and secondary connection devices 501, 502 comprise a duct 507, 508.
3. The apparatus 2" of any of items 1 or 2, wherein the first and second gas sources 511, 512 are a common gas source, preferably the atmosphere.
4. The apparatus 2" of any of items 1 to 3, wherein said pumping device 504 comprise one or more piezoelectric pumps.
5. The apparatus 2" of any of items 1 to 4, wherein the flow restriction 505 is a passive flow restriction.
6. The apparatus 2" of any of items 1 to 5, wherein the apparatus 2" further comprises a control unit, the control unit comprising an electric driver system, preferably an electronic driver system.
7. The apparatus 2" of item 6, wherein the apparatus 2" further comprises one or more sensors, preferably comprising a flow meter and/or a pressure sensor, and the control unit being configured to receive input from one or more of the one or more sensors.
8. The apparatus 2" of any of items 1 to 7, wherein the flow restriction 505 has a flow resistance, and the flow resistance is more than one twentieth of a nominal ratio of the pumping device 504 and less than half of the nominal ratio of the pumping device 504, said nominal ratio being the ratio $Qmax/\sqrt{\Delta P}$ between a nominal flow rate Qmax of the pumping device 504 and the square root of a nominal pressure head $\Delta Pmax$ of the pumping device 504.
9. The apparatus 2" of any of items 1 to 8, wherein the flow restriction 505 has a flow resistance and the flow resistance of the flow restriction 505 is such that the pressure at the main outlet 510 of the apparatus 2", when said main outlet 510 is closed, is lower by a factor (leak factor F) between 10% and 50%, preferably between 20% and 30%, and for example approximately 25% in the presence of said flow restriction 505, than the pressure at the main outlet 510 of the apparatus 2", when said main outlet 510 is closed and assuming that the flow restriction were fully closed.
10. An assembly comprising the apparatus 2" of any one of items 1 to 9 and a fluidic system, the fluidic system being fluidically connected to the main outlet 510 of the apparatus 2"; or comprising the apparatus 2" of any one of items 1 to 9, a reservoir of fluid and a fluidic system, the reservoir being fluidically connected to the main outlet 510 of the apparatus 2" and the fluidic system being fluidically connected to the reservoir.
11. A method of controlling pressure in a fluidic system, wherein said fluidic system is fluidically connected to the main outlet 510 of an apparatus 2" according to any of items 1 to 9, the method comprising adjusting one or both of said pumping device 504 and said flow restriction 505.
12. A method of controlling flow rate of a fluid in a fluidic system, wherein said fluidic system is fluidically connected to the main outlet 510 of an apparatus 2" according to any of items 1 to 9, or is fluidically connected to a reservoir of fluid, the reservoir being fluidically connected to the main outlet 510 of an apparatus 2" according to any of items 1 to 9, the method comprising adjusting one or both of said pumping device 504 and said flow restriction 505.
13. A non-transitory computer readable storage medium having stored thereon instructions that, when executed, cause at least one computing device to carry out the method of any one of items 11 to 12.

In this other aspect, the apparatus is preferably devoid of a connection device comprising a valve with a modifiable aperture. Other than that, the entire above description applies similarly to this aspect (the main connection device corresponding to the above first connection device and the secondary connection device corresponding to the above second connection device).

EXAMPLES

The following examples illustrate the invention without limiting it.

Example 1

The setup of FIG. 6 is used. The experimental set-up is composed of a piezoelectric air pump capable of delivering up to 0.75 l/min and a maximal achievable pressure of 400 mbar. The air pump is connected to a 20 ml reservoir at its outlet through a tubing. On the same air path, a manually settable passive leak is placed. The leak connects the tubing to the atmospheric pressure. A flow meter is placed at the leak output to atmosphere to measure the air flow of the leak. A pressure transducer is also mounted on the same air path to measure the pressure of the reservoir. A drive circuit sets the pump power and measures the pressure.

The details of the setup are provided in Table 2.

TABLE 2

| Description | Reference |
|---|---|
| Air pump | DP-S2-007 from TTP Ventus |
| Reservoir | 15 ml Ependorf + Fluigent pCAP + 4 mm diameter tubbing |
| Air flow meter | SFAH-0.1U-Q4S/SFAH-0.5U-Q4S |
| Pressure sensor | Honeywell ABP Series 1bar range analog |

TABLE 2-continued

| Description | Reference |
|---|---|
| Air leak | IDEX P-446NF |

In a first step, the air pump is set at maximal power (1 W), then the air leak is adjusted in order to obtain a desired flowrate by using the air flow meter. The leak factor is determined accordingly to pump achievable performance, i.e., the maximal pressure and the maximal flowrate. The pump flow constant used for leak factor formula, expressed by $\sqrt{\Delta P}max/Qmax$ equals to 14.05 ($\sqrt{0.4}/0.045$). The leak factor is deduced from the formula $F=Q/\sqrt{\Delta P}\times\sqrt{\Delta P}max/Qmax$ where pressure is expressed in bar and flowrate in $m^3$/hour.

The air leak is manually adjusted in order to match different leak factors. The leaked air flow Q through the flow restriction is deduced for different leak factors. Additionally, the expected maximal pressure is determined according to Table 3.

TABLE 3

| Leak factor (F) | Qleak (l/min) | Maximal achievable pressure (bar) |
|---|---|---|
| 0.05 | 0.0365 | 0.38 |
| 0.1 | 0.0711 | 0.36 |
| 0.2 | 0.1341 | 0.32 |
| 0.5 | 0.2904 | 0.24 |
| 0.75 | 0.3876 | 0.19 |
| 1.5 | 0.5625 | 0.1 |

In a second step, the air pump is set at maximal power (1 W), then the leak is manually adjusted in order to match a corresponding flowrate. The flowrate is read on the instrument embedded display. Multiple set-ups are tested for different leak factors as displayed in FIG. 5 in which the pump is excited by a Dirac signal as the control signal for 15 seconds at maximal power of 1 W. After this period, the pump is deactivated. Pressure is monitored every 0.01 s and sent to a computer for logging.

The maximal achievable pressure, depressurisation time and leak factor are then compared to theoretical values.

The trend of the data presented in Table 4 corresponds to the theoretical model. There is a small deviation from measured maximal pressure that might be induced by internal tubing, precision of the measures and flow path resistance of the set-up.

TABLE 4

| Estim. leak factor (F) | Meas. leak factor (F) | Estim. max. achievable pressure (bar) | Meas. maximal pressure (bar) | Estim. depressurization time at 63% (s) | Meas. depressurization time at 63% (s) |
|---|---|---|---|---|---|
| 0 | 0 | 0.40 | 0.40 | 0.40 | >600 |
| 0.05 | 0.05 | 0.38 | 0.36 | 0.36 | 20.1 |
| 0.10 | 0.10 | 0.36 | 0.34 | 0.34 | 9.8 |
| 0.20 | 0.20 | 0.32 | 0.31 | 0.31 | 3.9 |
| 0.50 | 0.53 | 0.24 | 0.21 | 0.21 | 0.9 |
| 0.75 | 0.79 | 0.19 | 0.17 | 0.17 | 0.3 |
| 1.50 | 1.58 | 0.1 | 0.09 | 0.09 | 0.2 |

Figure 5:
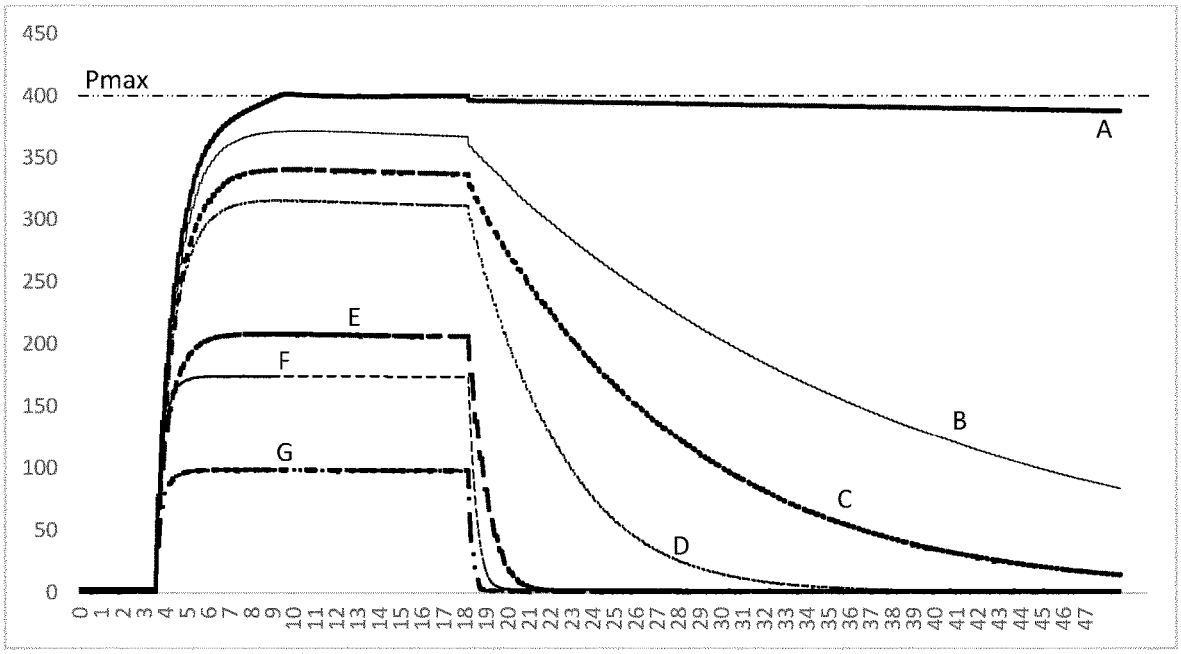
FIG. 5 shows the system time response and maximal achievable pressure of one embodiment of the invention, as a function of the leak factor of the valve. The pressure at the main outlet of the apparatus can be read on the Y-axis (in mbar) and the time can be read on the X-axis (in s).

The graphs on FIG. 5 respectively correspond to F=0 (graph A), F=0.05 (graph B), F=0.10 (graph C), F=0.20 (graph D), F=0.50 (graph E), F=0.75 (graph F) and F=1.50 (graph G).

Figure 4A:
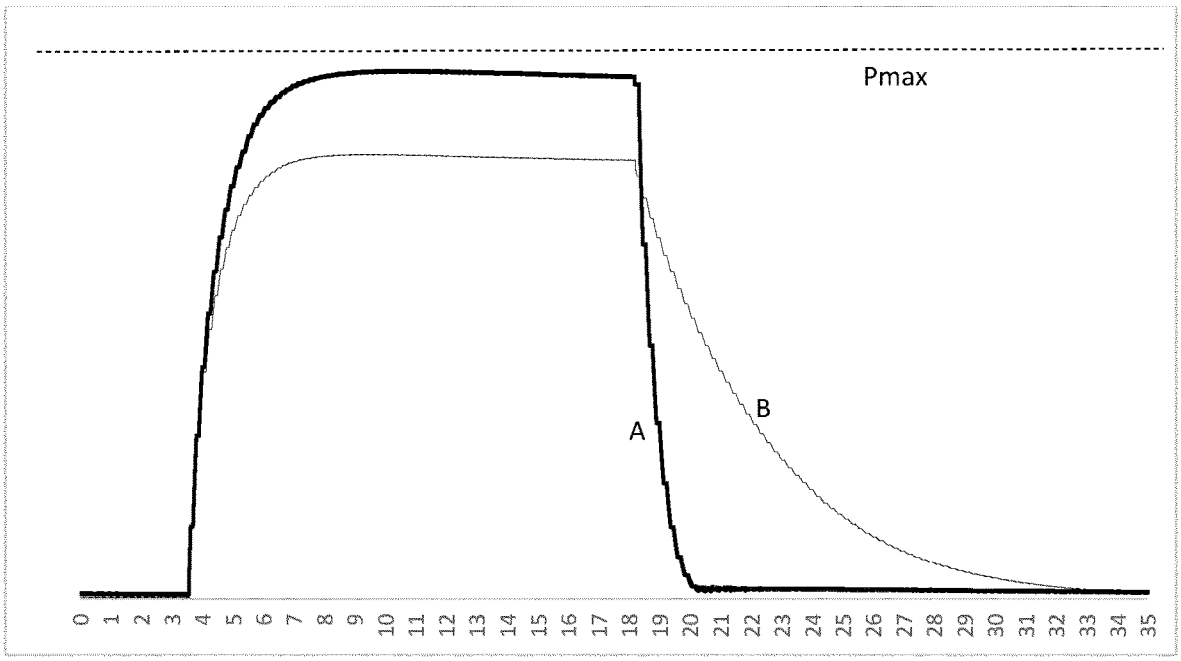
FIG. 4A shows examples of pressure responses of the embodiment of FIG. 3 and of a comparative setup, in response to a square-wave input as target pressure. The pressure at the main outlet of the apparatus can be read on the Y-axis and the time (in s) can be read on the X-axis.

FIG. 4A further displays the response of a setup according to the invention (graph A, on-off valve and passive leak with a leak factor set at 5%), and of a comparative setup (graph B, corresponding to FIG. 2 and comprising a pump and a passive leak with a leak factor set at 20%), to the control signal. The comparison shows that the invention affords significantly higher maximal pressure and shorter response time.

Figure 4B:
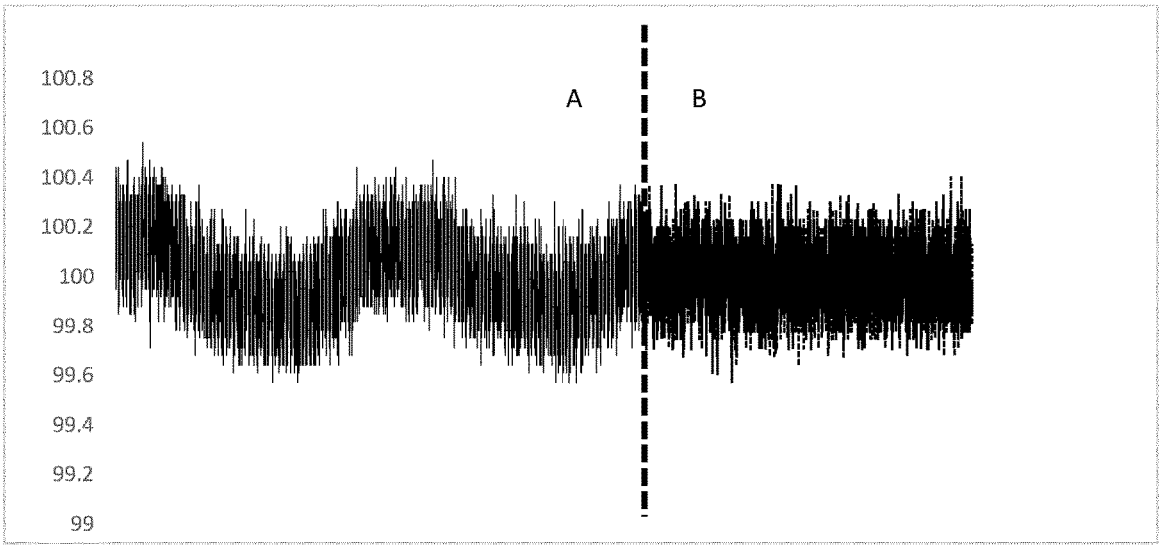
FIG. 4B shows the stability of the embodiment of FIG. 3 in comparison with a comparative setup of FIG. 2, in response to a constant pressure as input target. Instantaneous pressure at the main outlet of the apparatus can be read on the Y-axis (in percent, relative to the average pressure) and the time can be read on the X-axis.

FIG. 4B compares the stability, i.e., pulselessness of the pressure at the main outlet of the apparatus with (graph B) and without (graph A) the leak through the second outlet and the third outlet. Notably, the stability is improved by the introduction of the leak.

Example 2

Figure 9A:
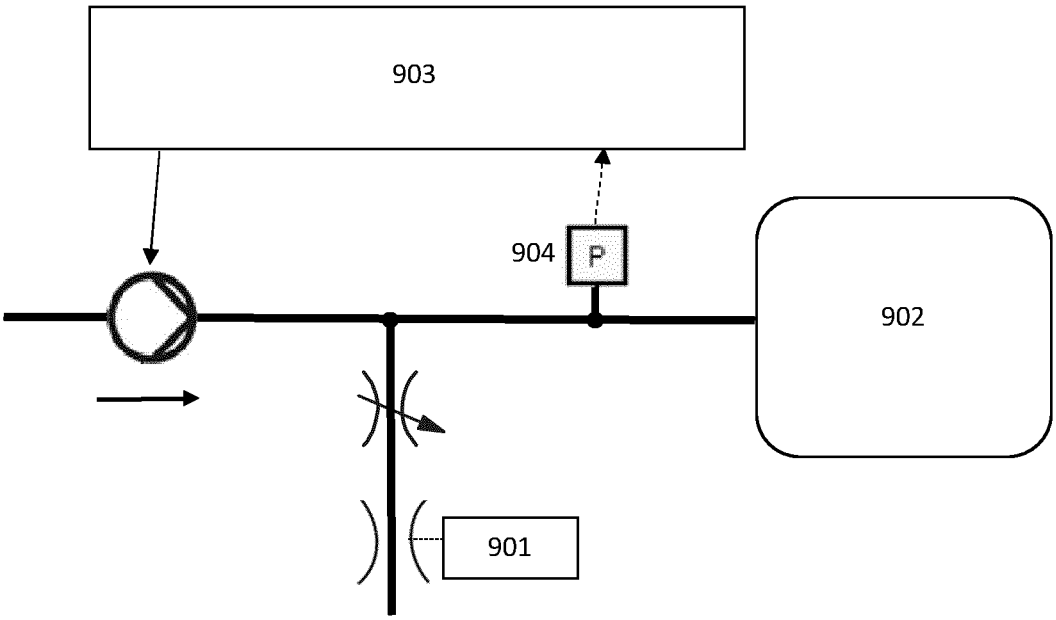
FIG. 9A-B show the experimental setup of a comparative assembly and an embodiment of the present invention.
Figure 9B:
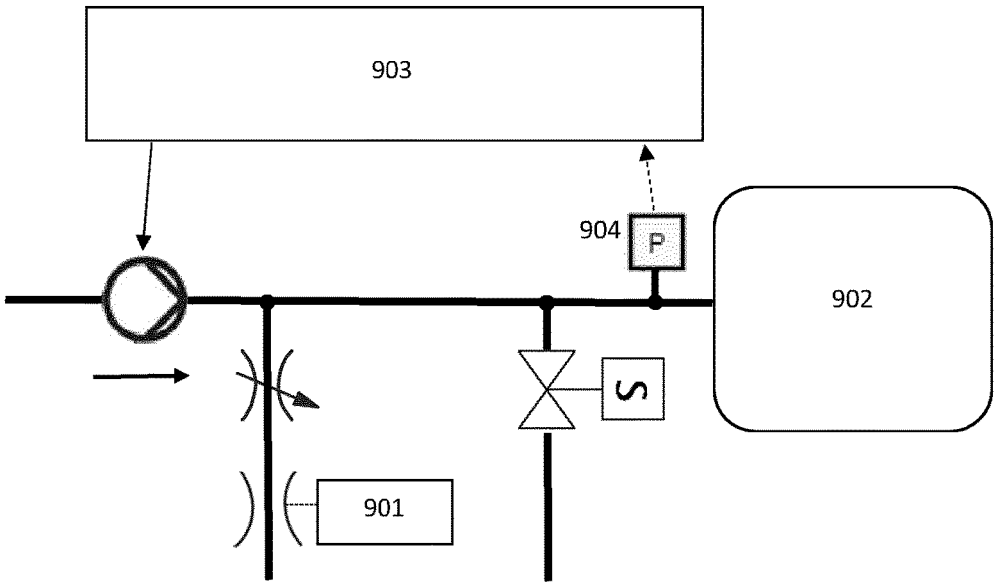

An experimental set-up is composed by two configurations: a comparative configuration as presented in FIG. 2 in an assembly according to FIG. 9A comprising a pump with a passive leak, and a configuration according to the embodiment presented in FIG. 3 in an assembly according to FIG. 9B, comprising a pump in combination with a passive leak and an on/off valve. Both systems are connected to a 20 ml air reservoir 902 in a pressurizing experiment. A control unit 903 a pressure sensor 904 and a flow meter 901 on the passive leak are further installed in the assemblies. All gas sources are the atmosphere.

The leak factor of the first system leak is set at 0.25. For the second system, the leak factor of the passive leak is set at 0.05 and the leak factor of the on/off valve at 1, i.e., fully open.

An algorithm is used to drive the air pump and the bimodal valve allowing a pressure regulation. Data is sent to a computer for logging and post processing. Additionally, a flow meter measures the gas consumed by the pump.

The operating method sets regulated pressure step orders. Used pump DP-S2-007 from TTP Ventus delivers a maximal achievable pressure of 400 mbar and a flowrate up to 0.75 L/min. Pressure steps for this experiment are 0 mbar, 150 mbar, 300 mbar, 150 mbar and finally 0 mbar. Between orders, a waiting delay allows the system to stabilize.

Figure 10A:
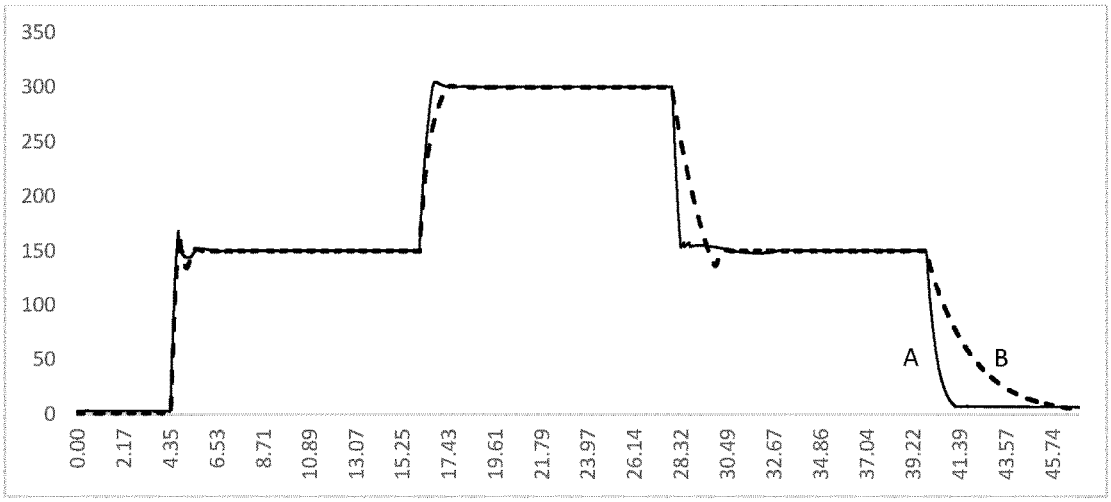
FIG. 10A-C shows an example of the pressure response, the flowrate of gas consumption, and the power consumption, respectively, in a comparative assembly and an assembly according to one embodiment the present invention. The time (in s) is indicated on the X-axis. The pressure (in mbar), gas flow rate (in L/min) and power (in mW) are respectively indicated on the Y-axis.
Figure 10B:
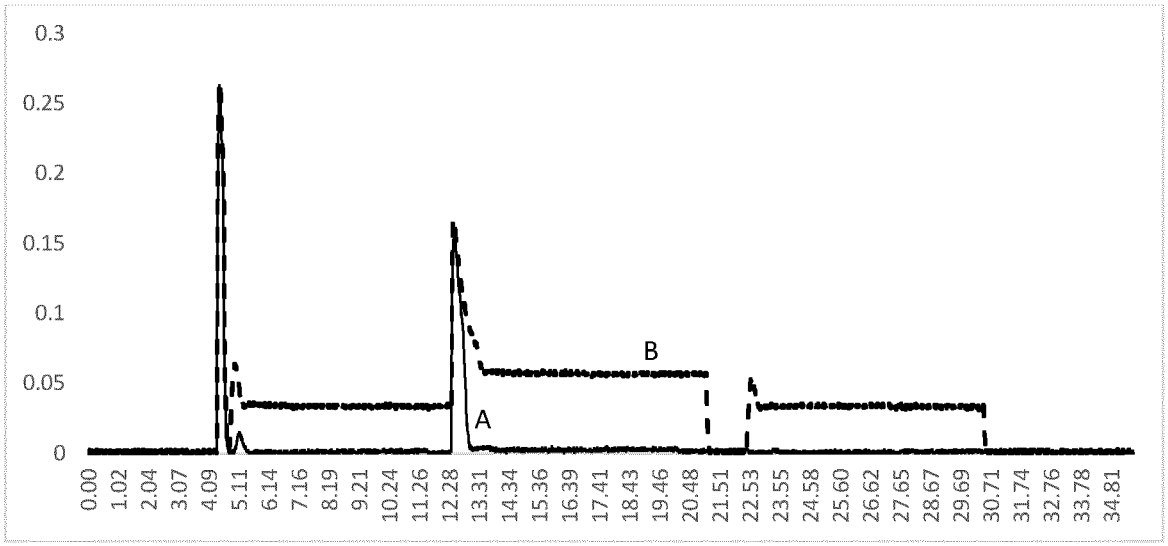
Figure 10C:
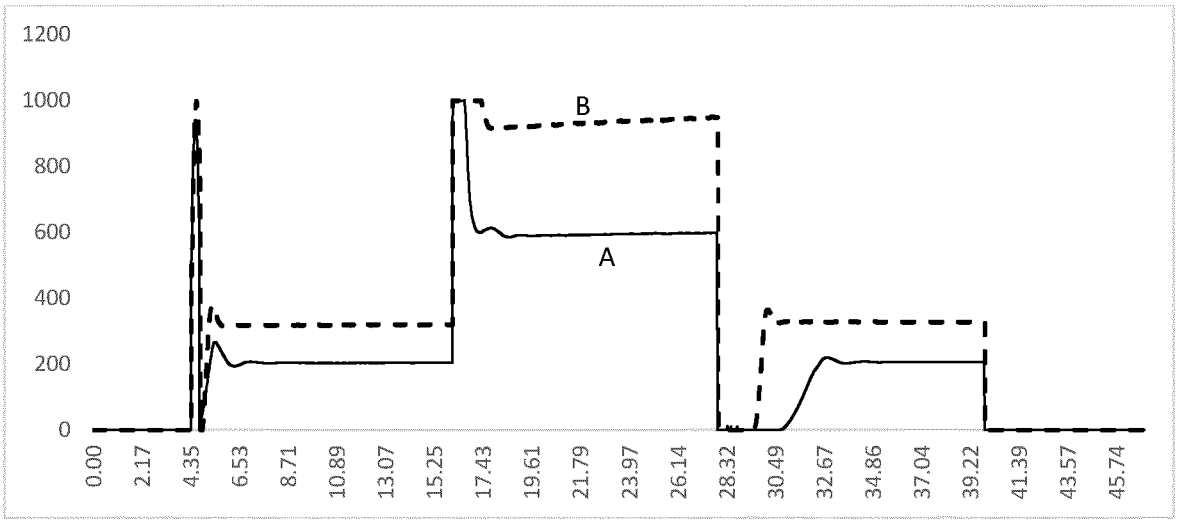

FIG. 10A shows the pressure response of the two systems (invention graph A, comparative graph B). FIG. 10B shows the gas flowrate consumed in the two systems (invention graph A, comparative graph B). With the use of the bimodal valve, gas is consumed only during pressurization phase. The first (comparative) system draws air in all cases except during depressurization or when pressure is at 0 mbar. FIG. 10C shows the power consumed by the pump for both systems (invention graph A, comparative graph B). Drawn power is considerably reduced in all cases when using the system with a bimodal valve. With the first system, a certain amount of energy is dissipated by the large passive leak.

This experiment exposes the improvement of gas consumption and used power of the pump. Those enhancements impact pump lifetime as it can operate at lower power, therefore for a longer time. Gas consumption can be a factor when using expensive or dangerous gases.

Example 3

The set-up is the same as in example 1, with a first comparative configuration and a second configuration according to the invention.

The first system leak is set at a leak factor of 0.25. The second system passive leak is set at 0.05 and the bimodal leak valve at 1.

An algorithm is used to drive the air pump and the bimodal valve allowing pressure regulation. Data is sent to a computer for logging and post processing.

Figure 11A:
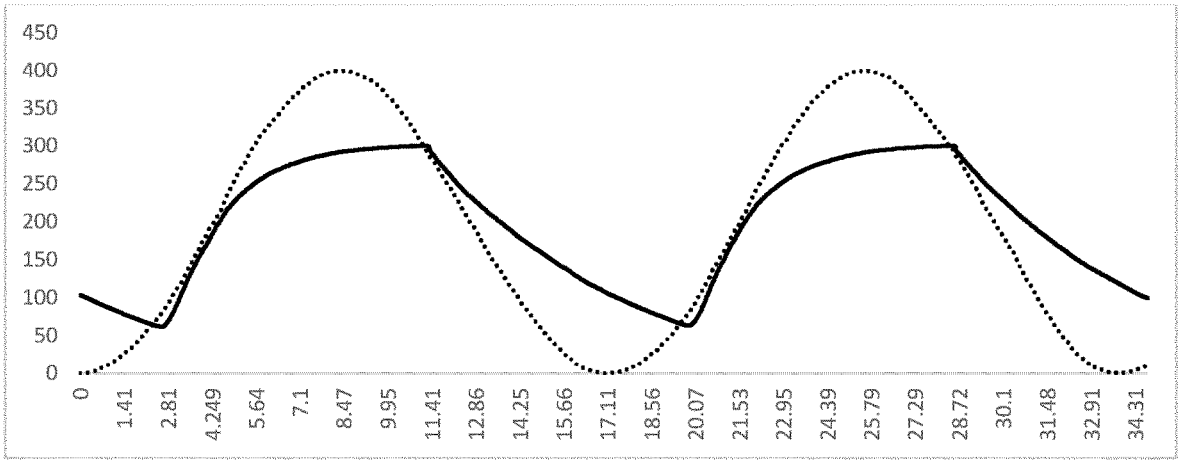
FIG. 11A shows an example of the pressure response to a sinusoidal waveform command in a comparative assembly of FIG. 9. The time (in s) is indicated on the X-axis. The pressure (in mbar) is indicated on the Y-axis.
Figure 11B:
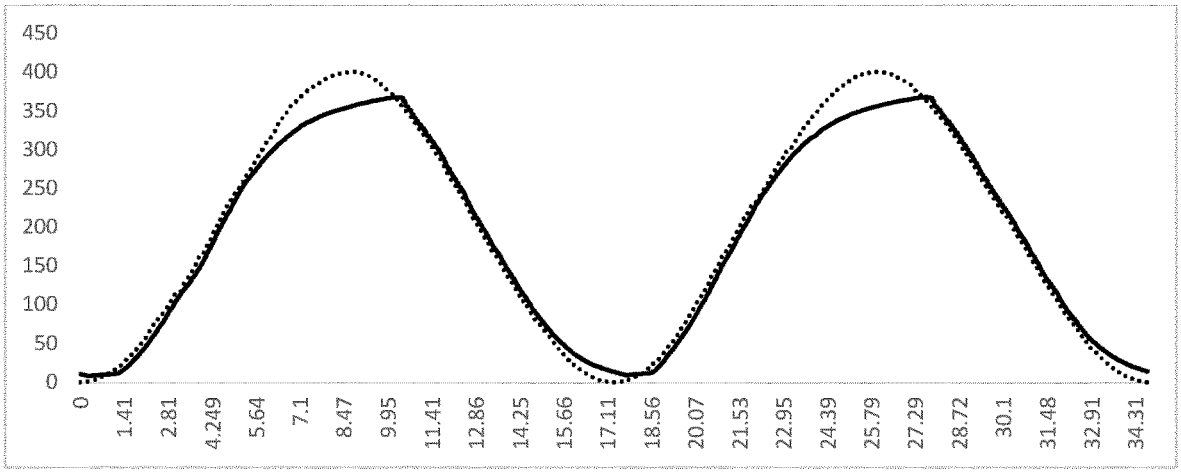
FIG. 11B shows an example of the pressure response to a sinusoidal waveform command in an assembly according to one embodiment the present invention. The time (in s) is indicated on the X-axis. The pressure (in mbar) is indicated on the Y-axis.

A sinusoidal waveform excitation command is sent as a pressure setpoint order. The period of the oscillation is 4.5 seconds, and the amplitude is 400 mbar. On FIG. 11A and FIG. 11B the measured pressure (full line) over time as a response to the sinusoidal waveform command (dotted line) are plotted, respectively for the comparative device (FIG. 11A) and the device according to an embodiment of the invention (FIG. 11B).

As the leak factor of the first system is lower than that of the second system, its response time during depressurization is slower. This results in an asymmetric pressure profile between pressurization and depressurization. The sinusoidal waveform command is poorly reproduced if the frequency is high (above 10 Hz). Additionally, the maximal achievable pressure is lower due to the passive leak.

Figure 11C:
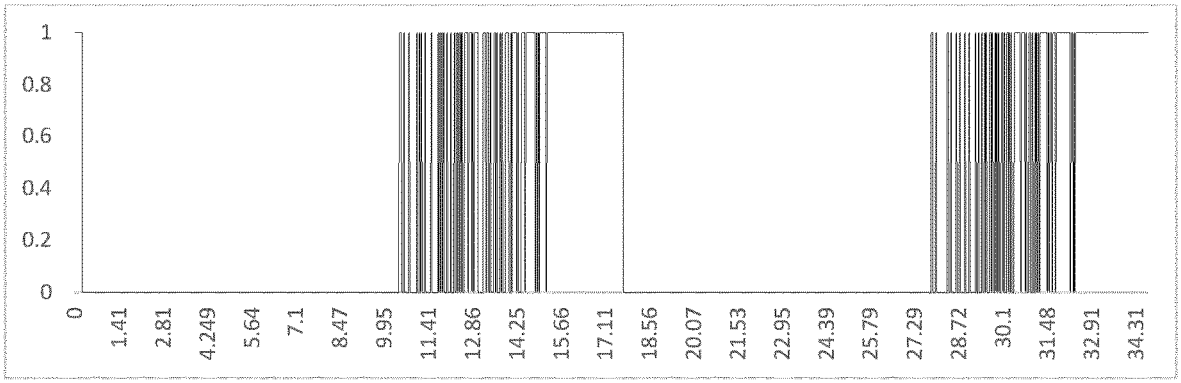
FIG. 11C shows the command of on/off valve. The time (in s) is indicated on the X-axis.

FIG. 11C shows the use of on/off valve during depressurization. Depending on the pressure drop to achieve and the pressure range, the valve is opened less or more. The control unit drives the valve based on its internal regulation algorithm.

This experiment shows an improvement on system response time in case of pressure regulation. The symmetry profile between pressurization and depressurization allows a satisfactory response to pressure orders.

What is claimed is:

1. An apparatus for controlling pressure or flow in a fluidic system, the apparatus comprising:

a first connection device comprising a pumping device, wherein said pumping device comprises one or more piezoelectric pumps, a duct having a main outlet at a first end, the duct being configured to be connected to a first gas source at a second end opposite the first end, the pumping device, positioned in the path of the duct, being configured to pump gas across said first connection device from the first gas source to the main outlet, or from the main outlet to the first gas source, and the main outlet being configured to be connected to said fluidic system or to a reservoir of fluid connected to said fluidic system;

a second connection device comprising a passive flow restriction, the second connection device being configured to be fluidically connected to a second gas source; and a third connection device comprising an on/off valve having two positions, a fully open position allowing unrestricted fluid flow and a fully closed position preventing fluid flow, the third connection device being configured to be fluidically connected to a third gas source;

wherein the second connection device and the third connection device are connected as a branch to the duct of the first connection device at a position between the pumping device and the main outlet.

2. The apparatus of claim 1, wherein one or more of the first, second, and third connection devices comprise a duct.

3. The apparatus of claim 1, wherein the first, second and third gas sources are a common gas source.

4. The apparatus of claim 1, wherein the apparatus further comprises a control unit, the control unit comprising an electric driver system.

5. The apparatus of claim 4, wherein the apparatus further comprises one or more sensors, and the control unit being configured to receive input from one or more of the one or more sensors.

6. The apparatus of claim 5, wherein the sensors comprise a flow meter and/or a pressure sensor.

7. The apparatus of claim 1, wherein the flow restriction has a flow resistance, and the flow resistance is more than one twentieth of a nominal ratio of the pumping device and less than half of the nominal ratio of the pumping device, said nominal ratio being the ratio ($Qmax/\sqrt{\Delta P}$) between a nominal flow rate (Qmax) of the pumping device and the square root of a nominal pressure head ($\Delta Pmax$) of the pumping device.

8. The apparatus of claim 1, wherein the flow restriction has a flow resistance, and wherein:

the flow restriction is a passive flow restriction, and the flow resistance of the flow restriction is such that the pressure at the main outlet of the apparatus, when said main outlet and the valve are closed, is lower by a factor from 2% and 15%, in the presence of said flow restriction, than the pressure at the main outlet of the apparatus, when said main outlet and the valve are closed and assuming that the flow restriction were fully closed; or the flow restriction is an active flow restriction, and the flow resistance of the flow restriction may be adjusted so that the pressure at the main outlet of the apparatus, when said main outlet and the valve are closed, is lower by a factor from 50% to 130%, in the presence of said flow restriction, than the pressure at the main outlet of the apparatus, when said main outlet and the valve are closed and assuming that the flow restriction were fully closed.

9. An assembly comprising the apparatus of claim 1 and a fluidic system, the fluidic system being fluidically connected to the main outlet of the apparatus; or comprising the apparatus of claim 1, a reservoir of fluid and a fluidic system, the reservoir being fluidically connected to the main outlet of the apparatus and the fluidic system being fluidically connected to the reservoir.

10. A method of controlling pressure in a fluidic system, wherein said fluidic system is fluidically connected to the main outlet of the apparatus of claim 1, the method comprising adjusting one or more of said pumping device, said passive flow restriction, and said on/off valve.

11. The method of claim 10, wherein the on/off valve is closed when said pumping device pumps gas across said first connection device from the first gas source to the main outlet, or from the main outlet to the first gas source and is open otherwise.

12. A non-transitory computer readable storage medium having stored thereon instructions that, when executed, cause at least one computing device to carry out the method of claim 10.

13. The method of claim 10, comprising the following steps, in any order:

increasing pressure at the main outlet, wherein the pumping device is operated, the on/off valve is closed, and the passive flow restriction is open;

maintaining a constant pressure at the main outlet, wherein the pumping device is operated, the on/off valve is closed, and the passive flow restriction is open; and decreasing pressure at the main outlet, wherein the pumping device is shut off, the on/off valve is open, and the passive flow restriction is open.

14. A method of controlling flow rate of a fluid in a fluidic system, wherein said fluidic system is fluidically connected to the main outlet of the apparatus of claim 1, or is fluidically connected to a reservoir of fluid, the reservoir being fluidically connected to the main outlet of an apparatus of claim 1, the method comprising adjusting one or more of said pumping device, said passive flow restriction, and said on/off valve.

15. The method of claim 14, comprising the following steps, in any order:

increasing pressure at the main outlet, wherein the pumping device is operated, the on/off valve is closed, and the passive flow restriction is open;

maintaining a constant pressure at the main outlet, wherein the pumping device is operated, the on/off valve is closed, and the passive flow restriction is open; and decreasing pressure at the main outlet, wherein the pumping device is shut off, the on/off valve is open, and the passive flow restriction is open.

16. The apparatus of claim 1, wherein the passive flow restriction is a capillary.

17. The apparatus of claim 1, wherein the passive flow restriction has an unmodifiable flow resistance value.

* * * * *